United States Patent [19]

Hoettels

[11] 4,399,777

[45] Aug. 23, 1983

[54] ENGINE BLOCK

[75] Inventor: Ronald W. Hoettels, Colgate, Wis.

[73] Assignee: Teledyne Industries, Inc., Milwaukee, Wis.

[21] Appl. No.: 293,274

[22] Filed: Aug. 17, 1981

[51] Int. Cl.[3] ..... F02B 75/22

[52] U.S. Cl. ..... 123/55 R; 123/52 MV; 123/195 R; 123/DIG. 6; 123/DIG. 8

[58] Field of Search ..... 123/DIG. 1, DIG. 6, 123/DIG. 7, DIG. 8, 52 MV, 195 R, 55 R, 55 VF, 55 VS, 55 VE, 55 V, 55 A

[56] References Cited

U.S. PATENT DOCUMENTS

| | | | |
|---|---|---|---|
| 1,217,020 | 2/1917 | Laurents | 123/55 R |
| 1,276,389 | 8/1918 | Mason et al. | 123/55 VE |
| 1,292,165 | 1/1919 | Vincent | 123/55 R |

FOREIGN PATENT DOCUMENTS

| | | | |
|---|---|---|---|
| 851616 | 10/1960 | United Kingdom | 123/DIG. 7 |

*Primary Examiner*—Craig R. Feinberg

*Attorney, Agent, or Firm*—Gifford, VanOphem, Sheridan & Sprinkle

[57] ABSTRACT

An engine block for a reciprocal piston internal combustion engine which is constructed from two substantially identical block halves. Each block half includes a mating surface formed around its outer periphery which is symetrical about the center line and a cylinder adapted to receive a reciprocal piston. Each block further includes a pair of manifold passageways wherein one end of each passageway is adapted to be connected to the cylinder through a valve means while the other of each passageway is open to the mating surface on opposite sides of and equidistantly spaced from the center line. A recessed channel is formed in the mating surface and extends from the other end of each passageway and to the outer edge of the mating surface. The engine block halves are secured together so that the mating surfaces abut together whereupon the recessed channels on one block half register with the recessed channels on the other block half. One pair of registering channels forms the fuel/air intake for the engine block while the other pair of registering channels form the exhaust outlet from the engine block.

9 Claims, 5 Drawing Figures

ENGINE BLOCK

BACKGROUND OF THE INVENTION

I. Field of the Invention

The present invention relates generally to engine blocks and, more particularly, to an engine block for a reciprocal piston engine.

II. Description of the Prior Art

The engine blocks for internal combustion engines, and particularly for relatively small multicylinder engines, are typically constructed by casting the entire engine block with its two or more cylinders as a single piece. In addition, an intake and exhaust manifold is also constructed by casting, usually as a one-piece unit, and subsequently secured to the engine block.

This previously known method for constructing engines blocks for small multicylinder engines is disadvantageous in several different respects. One disadvantage of these previously known engine blocks is that it is difficult and expensive to cast the relatively large engine block.

A still further disadvantage of these previously known small multicylinder engines is that the exhaust and intake manifolds must be cast separately from the engine block thus further increasing the overall price of the engine. Furthermore, the subsequent assembly of the exhaust and intake manifold to the engine block requires not only additional assembly labor cost but also the additional material cost of the nuts, bolts, gaskets and the like to attach the manifolds to the engine block.

SUMMARY OF THE PRESENT INVENTION

The present invention overcomes the above mentioned disadvantages of the previously known engine blocks for small multicylinder engines by providing a simple, inexpensive and yet durable small engine block construction.

In brief, the engine block according to the present invention comprises a pair of substantially identical block halves each of which has at least one cylinder formed in it adapted to receive a piston. In addition, each engine block has a mating surface formed on one side around its outer periphery and this mating surface is symmetrical about a center line extending from the top and to the bottom of the engine block.

A pair of manifold passageways are formed within each block half and one end of each passageway is adapted to be connected through a valve means with the cylinder formed in the block half. Conversely, the other or second ends of the passageways are open to the mating surface on opposite sides of and equidistantly spaced from the center line. In addition, these other or second ends of the passageways are transversely aligned with each other.

At least one recessed channel is formed in the mating surface between the second end of each passageway and the outer edge of the mating surface. The two block halves are then positioned together so that their mating surfaces flatly abut against each other and, in doing so, the recessed channels on one block half register with the recessed channels on the other block half. Each pair of registering channels thus forms a connecting passage between the exterior of the attached block halves and the manifold passageway associated with the connecting passage. One connecting passageway forms the fuel/air intake for the engine while the other connecting passage forms the exhaust outlet from the engine.

The engine block according to the present invention is thus advantageous in that two relatively small engine block halves can be formed by casting, and preferably by die casting, and then secured together to form the engine block. Furthermore, it is much less expensive to construct two relatively small engine block halves by casting and thereafter securing these engine block halves together to form the engine block than it is to cast the entire engine block as a single piece. The overall cost of casting is even further reduced since the engine block halves are substantially identical to each other.

A still further advantage of the engine block according to the present invention is that it eliminates the necessity of separately casting an intake and exhaust manifold for the engine as a separate piece since the registering recessed channels automatically form the intake and exhaust manifold ports for the engine when the engine block halves are secured together. Moreover, since the recessed channels are formed on the parting or mating surfaces, these recesses can be inexpensively and quickly machined.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
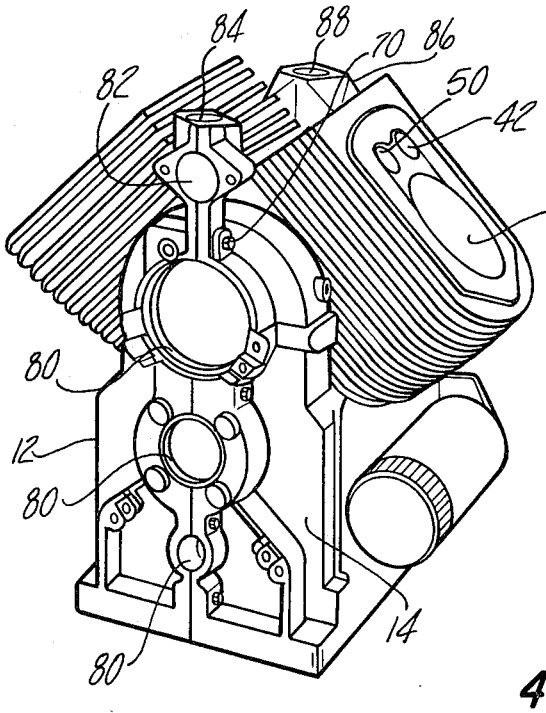
FIG. 1 is a front elevational view illustrating a preferred embodiment of the engine block according to the present invention.
Figure 2:
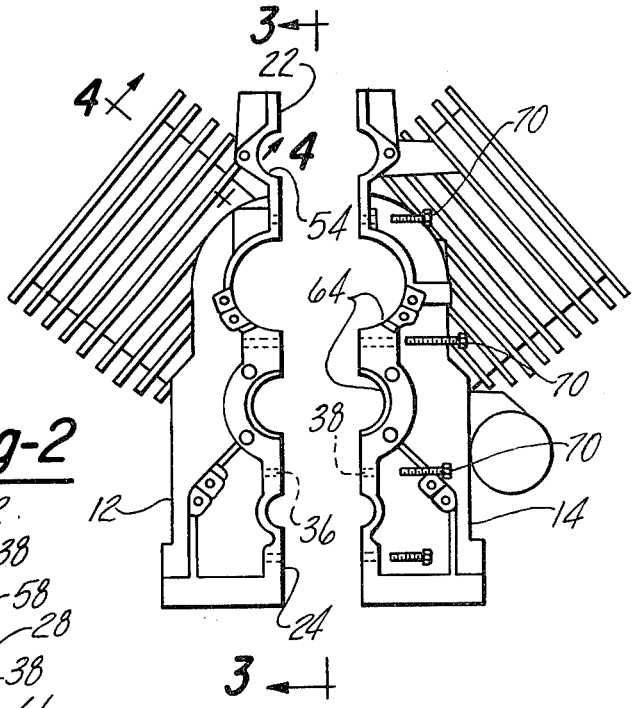
FIG. 2 is an exploded end view illustrating the preferred embodiment of the invention.

With reference first to FIGS. 1 and 2, a preferred embodiment of the engine block according to the present invention is thereshown and comprises a first block half 12 and a second block half 14. Each of the block halves 12 and 14 is substantially identical to the other so that only one block half 12 will be described in detail, it being understood that a like description shall also apply to the other block half 14.

Figure 3:
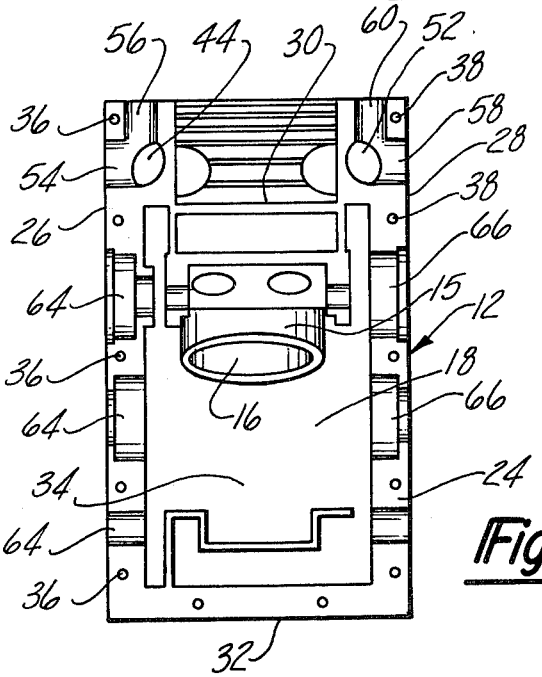
FIG. 3 is a view taken substantially along line 3—3 in FIG. 2.
Figure 5:
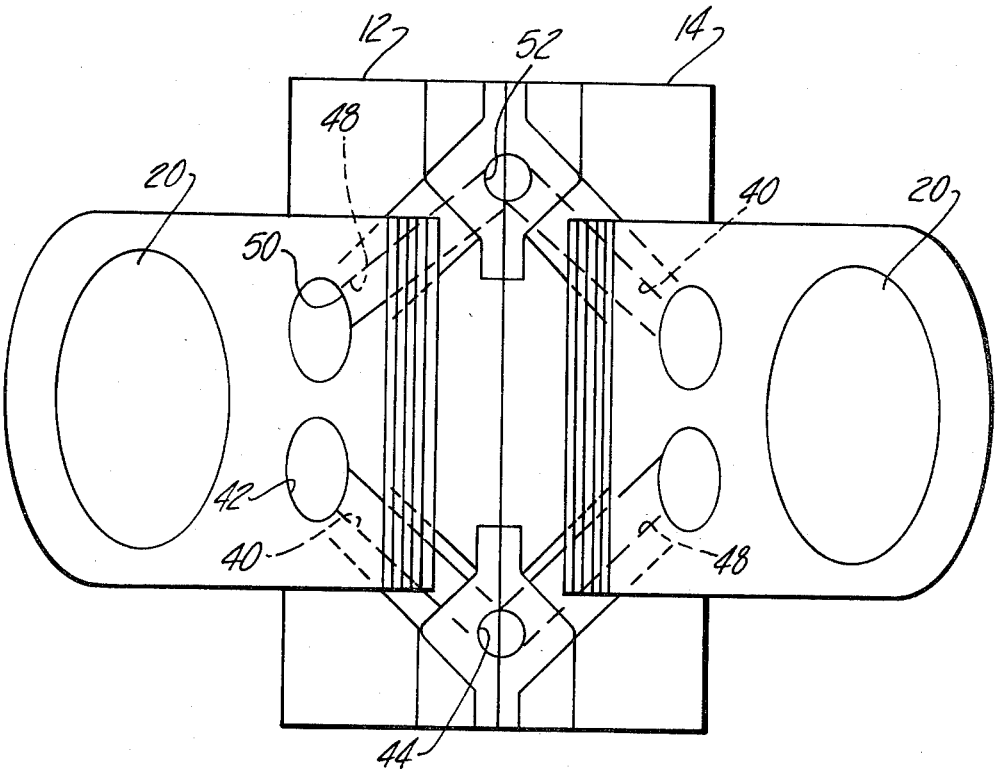
FIG. 5 is a top partial diagrammatic view of the preferred embodiment of the invention.

With reference now particularly to FIGS. 2, 3 and 5, the block half 12 is preferably formed by die casting and has a cylinder liner 15 defining a cylinder 16 formed in it which is adapted to slidably receive a reciprocal piston (not shown). The cylinder liner 15 is preferably formed by casting although a pressed in cylinder liner can alternatively be used. The inner end of the cylinder 16 is opened to a recessed portion 18 (FIG. 3) of the block half 12 while the other end 20 of the cylinder 16 (FIG. 5) is open exteriorly to the top of the block half 12.

Referring to FIGS. 2 and 3, one side 22 of the block half 12 includes a planar mating surface 24 which is generally rectangular in shape when viewed in plan (FIG. 3). As viewed in FIG. 3, the mating surface 24 thus has a right side 28 and a left side 26, a top 30 and a bottom 32.

With reference now particularly to FIG. 3, the mating surface 24 is symetrical along a longitudinal centerline 34 which bisects the top 30 and bottom 32 of the mating surface 24. A plurality of internally threaded fastener openings 36 are formed along the left side 26 of the mating surface 24 and a like number of fastener throughbores 38 are formed along the right side 28 of the mating surface 24. Due to the symetry of the mating surface 24, one fastener throughbore 38 is transversely aligned with one fastener opening 36. The fastener throughbores 38 and openings 36 are also equidistantly spaced from the center line 34.

Figure 4:
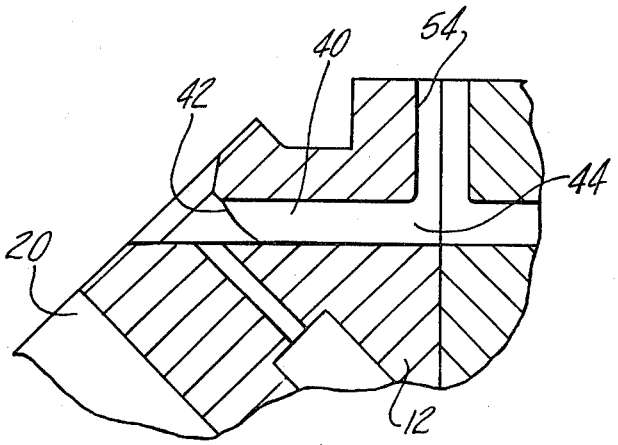
FIG. 4 is a cross sectional view taken substantially along line 4—4 in FIG. 2.

With reference now particularly to FIGS. 3–5, a first passageway 40 is formed through the block half 12 so that a first end 42 of the passageway 40 is open to the top of the block half adjacent the top 20 of the cylinder 16. This end 42 of the passageway 40 is adapted to be connected to the engine cylinder 16 through valve means (not shown). The other end 44 of the passageway 40 is open to the left side 26 of the mating surface 24 adjacent the top 30 of the mating surface 24.

Similarly, a second passageway 48 is also formed through the engine block half 12. A first end 50 of the passageway 48 is open to the top of the engine block and is adapted to be connected to the engine cylinder 16 by suitable valve means (not shown). The other or second end 52 of the passageway 48 is open to the right side 28 and adjacent the top 30 of mating surface 24. The second ends 44 and 52 of the passageways 40 and 48, respectively, which are open to the mating surface 24 are transversely aligned with each other and equidistantly spaced from the center line 34.

With reference now particularly to FIGS. 2 and 3, a recessed channel 54 extends transversely outwardly from the second end 44 of the passageway 40 and to the outer edge of the mating surface 24 on the left side 26. Preferably, a second channel 56 is recessed in the left side of the mating surface 24 and extends longitudinally outwardly from the second end 44 of the passageway 40 and to the top edge 30 of the mating surface 24.

Similarly, a recessed channel 58 in the right side 28 of the mating surface 24 transversely extends between right edge of the engine block and the second end 52 of the other passageway 48. A further recessed channel 60 in the mating surface 24 connects the second end 52 of the passageway 48 with the top edge 30 of the block half 12. The recessed channels 56 and 60 are transversely aligned with each other and equidistantly from the center line 34 and, likewise, the recessed channels 54 and 58 are transversely aligned with each other and equidistantly spaced from the center line 34.

At least one and preferably several semicircular depressions 54 are formed along the left side 26 of the mating surface 24 while, similarly, a like number of aligned semicircular recesses 66 are formed along the right side 28 of the mating surface 24. As will become shortly apparent, these recesses 64 and 66 form bearing retainers or, alternatively, rotatably support an engine shaft.

With reference now particularly to FIGS. 1 and 2, the engine block according to the present invention is constructed by placing the substantially identical engine block halves 12 and 14 together so their mating surfaces 24 flatly abut against each other. In doing so, the internally threaded fastener openings 36 on the left side 26 of the block half 12 register with the fastener throughbores 38 on the right 28 of the other block half 14 and suitable fasteners, such as bolts 70, are used to secure the block halves 12 and 14 together. Through bolts with their associated nuts (not shown) also extend through registering throughbores in the block halves 12 and 14 to secure the block halves 12 and 14 together. Simultaneously, the semicircular recesses 64 on the left side 26 of the block half 12 register with the semicircular recesses 66 on the right side 28 of the other block half 14, and vice versa, thus forming registering circular openings 80 (FIG. 1) or each side of the engine block. These openings 80 support bearing and/or rotatably support shafts, such as the engine crank shaft (not shown) within the interior of the engine block in the area defined between the cavities 18.

With reference now to FIGS. 3–5, when the block halves 12 and 14 are secured together as described above, the end 44 of the first passageway 40 on one block half 12 registers with the end 52 of the second passageway 48 on the other block 14, and vice versa. Therefore, the first passageway 40 in one block half 12 is connected with the second passageway 48 in the other block half 14 to form either the intake or exhaust manifold to the cylinders 16 in both block halves 12 and 13. Likewise, the second passageway 48 in the first block half 12 is connected with the first passageway 40 in the other block half to form the other of the intake or exhaust manifold from the cylinders 16 in both block halves. It, therefore, can be seen that, once the block halves 12 and 14 are secured together, either end of the engine block can be designated as intake or exhaust depending on the desired engine configuration.

Simultaneously, the channels 54 and 56 on the left side 26 of the block half 12 respectively register with the channels 58 and 60 on the right side 28 of the other block half 14, and vice versa. In doing so, the registering channels 54 and 58 on the block halves 12 and 14, respectfully, form a transverse connecting passage to the intake manifold first passageway 40 which is open at 82 (FIG. 1) exteriorly of the assembled engine block. Likewise, the passageway 56 on the block half 12 registers with the channel 60 on the block half 14 and forms a longitudinal connecting passage to intake manifold which is open at 84 (FIG. 5) exteriorly of the engine. At the same time, the remaining recessed channels 58 and 60 on the block half 12 respectively register with the channels 54 and 56 on the other block half 14 to form both transverse and longitudinal connecting passages which are open at 86 and 88 to the exhaust manifold.

With the engine block halves secured together as described above, either the opening 82 and 84 forms the fuel/air intake part for the engine while either the opening 88 and 86 forms the exhaust port from the engine.

In most applications, either the opening 82 or 84 will be closed by a cover plate (not shown) and the remaining open port 82 or 84 connected to the engine carburetor (not shown) to provide the fuel/air mixture to the engine. Similarly, either the port 88 or 86 will typically be closed by a cover and the remaining open port 88 or 86 used as the exhaust port or outlet from the engine. The provision of the two inlet ports 82 and 84 and two outlet ports 86 and 88, however, is advantageous since these dual ports enhance the flexibility in mechanically attaching both the carburetor to the fuel/air inlet port and the exhaust system to the exhaust outlet port.

In addition, if desired, thermal liners can be positioned within the exhaust port to protect the engine block from excessive heat.

From the foregoing, it can be seen that the engine block according to the present invention is advantageous in several different respects. First, the engine block according to the present invention is advantageous in that it is constructed primarily from two substantially identical block halves 12 and 14 which are preferably formed by die casting. Due to the relatively small size of the block halves 12 and 14, they can be relatively inexpensively constructed. Likewise, since the block halves 12 and are substantially identical to each other, the same casting pattern or mold can be used for both block halves 12 and 14.

A still further advantage of the present invention is that the intake and exhaust manifold passages are open to the parting or mating surfaces 24 of the block halves 12 and 14. This provision thus eliminates the necessity of assembling a separate manifold to the engine block as well as its necessary associated hardware, such as seals, gaskets, bolts and the like.

A yet further advantage of the split block construction of the present invention is that both the cylinder lining and the valve seat inserts can be formed by casting in lieu of the conventional pressed in construction. However, if desired, the conventional pressed in construction can be used with the engine block construction of the present invention.

Having described my invention, however, many modifications thereto will become apparent to those skilled in the art to which it pertains without deviation from the spirit of the invention as defined by the scope of the appended claims.

I claim:

1. An engine block for an internal combustion engine comprising:

a pair of substantially identical block halves, each block half having a mating surface symetrical about a center line formed around the outer periphery on one side and a cylinder adapted to slidably receive a piston, a pair of passageways formed in each block half, said passageways being adapted for connection at one end to said cylinder and open at their other ends to said mating surface on opposite sides of said center line, said other ends of said passageways being equidistantly spaced from said center line and transversely aligned with each other, a pair of channels recessed in the mating surface of each block half, one channel extending between each end of said passageways being in communication therewith and to the outer edge of said mating surface, means for securing said block halves together so that said mating surfaces abut together and so that said channels on one block half register with said channels on the other block half, and wherein one pair of registering channels forms a fuel-/air intake port for the engine block while the other pair of registering channels forms an exhaust outlet for the engine block.

2. The invention as defined in claim 1 wherein each block half is formed by die casting.

3. The invention as defined in claim 1 wherein each block half further comprises a pair of spaced and transversely aligned semicircular recesses on opposite sides of each block half, said semicircular recesses adapted to receive and support a bearing assembly for an engine shaft.

4. The invention as defined in claim 1 wherein either pair of registering channels can be selected as the intake port or the exhaust outlet.

5. The invention as defined in claim 1 wherein each block half includes a cylinder liner formed by casting.

6. The invention as defined in claim 1 wherein said mating surface comprises a top edge and two side edges which intersect opposite ends of the top edge, said center line extending in between said side edges, and wherein each of said channels extend from its associated other end of the passageway and to the adjacent side edge of the mating surface.

7. The invention as defined in claim 2 and further comprising a plurality of internally threaded recesses formed along one side of the mating surface and a plurality of throughbores formed through the other side of the mating surface, wherein each threaded recess is transversely aligned and equidistantly spaced from the center line with one throughbore.

8. The invention as defined in claim 6 and further comprising a pair of second channels recessed in said mating surface, one of said second channels extending between the top edge of the mating surface and to said other end of each passageway being in communication therewith.

9. The invention as defined in claim 8 wherein each of said first channels is substantially perpendicular to its associated second channel.

* * * * *